United States Patent [19]

Carnavos

[11] Patent Number: 4,554,969

[45] Date of Patent: Nov. 26, 1985

[54] COAXIAL FINNED TUBE HEAT EXCHANGER

[75] Inventor: Theodore C. Carnavos, Bethel, Conn.

[73] Assignee: Noranda Metal Industries, Inc., Newton, Conn.

[21] Appl. No.: 648,571

[22] PCT Filed: Dec. 22, 1982

[86] PCT No.: PCT/US82/01784

§ 371 Date: Aug. 20, 1984

§ 102(e) Date: Aug. 22, 1984

[87] PCT Pub. No.: WO84/02572

PCT Pub. Date: Jul. 5, 1984

[51] Int. Cl.[4] ..... F28D 7/10; F28F 9/22; F28F 13/06

[52] U.S. Cl. ..... 165/154; 165/70; 165/161

[58] Field of Search ..... 165/70, 109 R, 109 T, 165/140, 141, 154, 156, 161

[56] References Cited

U.S. PATENT DOCUMENTS

| | | | |
|---|---|---|---|
| 830,248 | 9/1906 | Von Orth . | |
| 928,063 | 7/1909 | Moneuse . | |
| 3,335,655 | 8/1967 | McCuiston . | |
| 4,228,848 | 10/1980 | Wadkinson, Jr. | 165/70 X |

FOREIGN PATENT DOCUMENTS

| | | |
|---|---|---|
| 802161 | 12/1950 | Fed. Rep. of Germany . |
| 888255 | 7/1953 | Fed. Rep. of Germany . |
| 605845 | 6/1926 | France . |
| 500389 | 2/1939 | United Kingdom . |

*Primary Examiner*—Sheldon J. Richter

*Attorney, Agent, or Firm*—Fleit, Jacobson, Cohn & Price

[57] ABSTRACT

A coaxial finned tube heat exchanger is disclosed. The heat exchanger comprises a hollow shell (10), a tube (14) mounted coaxially within such shell and having radially extending outer fins (16) of substantially large radial dimension in relation to the tube diameter. A first heat exchange fluid is passed in the tube and means (12) are provided for passing a second heat exchanger fluid through the shell. A plurality of segmental cut baffles (18) are mounted between adjacent fins at a predetermined spacing within the shell so as to achieve a cross-flow pattern for the second fluid between the fins of the tube, and a pair of bypass flow blockers (22) are mounted longitudinally on the tip of the fins to block circumferential flow of the second fluid between the shell and the tips of the fins and so force the fluid flow between the fins.

8 Claims, 6 Drawing Figures

COAXIAL FINNED TUBE HEAT EXCHANGER

This invention relates to a coaxial finned tube heat exchanger.

Heat exchangers of the type including a hollow shell and one or a plurality of smooth tubes arranged interiorly of the shell are well known. Generally, a heating or cooling fluid flows through the tubes whereas the fluid to be heated or cooled flows through the shell and impinges the outside surface of the tubes. With heat exchangers having a plurality of tubes, baffles are normally arranged inside the shell for changing the direction of flow of the fluid to be heated or cooled to improve heat transfer.

The present invention concerns a special type of heat exchanger for heating or cooling viscous fluids and gases and finds specific application in heating or cooling heat transfer oils, hydraulic oils and lubricating oils as well as heating or cooling gases, such as air, nitrogen or the like. Oils and gases have poor heat transfer characteristics relative to say water. This is generally compensated for by using more heat transfer surface which normally means larger, more costly heat exchangers. Conventional shell and multi-smooth tube exchangers have a relatively low capacity level to house heat transfer surface. The ratio of heat transfer area to total volume does not generally exceed 100 $ft^2/ft^3$.

It is therefore the object of the present invention to provide a heat exchanger for oils and gases having a higher ratio of heat transfer area to total volume.

The coaxial heat exchanger, in accordance with the present invention, comprises a hollow shell, a tube mounted coaxially within the shell and having radially extending outer fins of substantially large radial dimension in relation to the tube diameter, means for passing a first heat exchange fluid in the tube, means for passing a second heat exchange fluid through the shell, a plurality of segmental cut baffles mounted between adjacent fins at a predetermined spacing within the shell so as to achieve a cross flow pattern for the second fluid between the fins of the tubes, and a pair of bypass flow blockers mounted longitudinally on the tip of the fins to block circumferential flow of the second fluid between the shell and the tip of the fins and so force the fluid flow between the fins.

The baffles are spaced at predetermined intervals according to the heat transfer application. The space between the shell and the tip of the fins is also according to the application.

The bypass flow blockers are preferably a pair of rods or strips attached to the fin tips at the cut points of the baffles.

The tube is preferably provided with internal fins or other internal tube augmentation schemes, but it may also be smooth on the inside. A second tube may be inserted inside the finned tube and suitable grooves or protuberances provided on the inside surface of the finned tube or the outside surface of the second tube for leakage detection. Such second tube may be provided with internal fins or other internal tube augmentation schemes.

The invention will now be disclosed, by way of example, with reference to the accompanying drawings in which.

Figure 1:
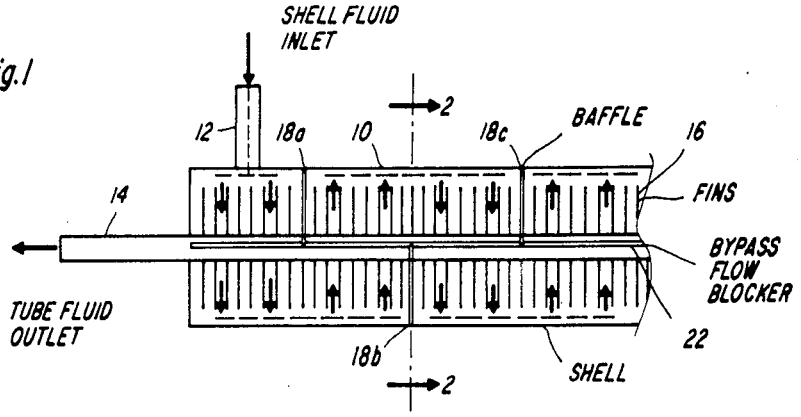
FIG. 1 illustrates a schematic view of a heat exchanger in accordance with the invention.
Figure 2:
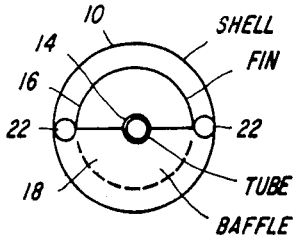
FIG. 2 illustrates a view along line 2—2 of FIG. 1.
Figure 3:
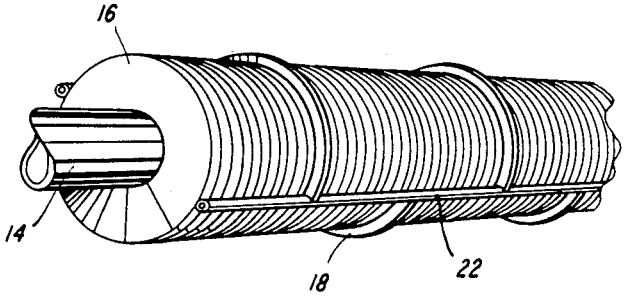
FIG. 3 illustrates a perspective view of the tube of the heat exchanger in accordance with the invention.

Referring to FIG. 1, there is schematically shown an embodiment of a heat exchanger in accordance with the invention. The heat exchanger comprises a hollow shell 10 which is closed at both ends and provided with a shell fluid inlet 12 at one end and a shell fluid outlet (not shown) at the other end. A tube 14 provided with radially extending outer fins 16 of substantially large radial dimension in relation to the tube diameter, preferably in a range between 2 to 1 and 3 to 1, is inserted inside the heat exchanger shell before closing the ends thereof. The tube 14 is for passing the heating or cooling fluid through the heat exchanger. Segmental baffles **18*a*, 18*b*, 18*c*, . . . having a diameter slightly less than the inner diameter of the shell are located within the shell between the fins at predetermined space intervals. The segmental cut baffles are arranged to provide a cross flow pattern for the fluid to be heated or cooled as shown by arrows 20 in FIG. 1. Such flow extends from the shell fluid inlet to the space between the tip of fins and the shell and down between the fins to the identical opposite space between the tip of the fins and the shell. The fluid then flows along the shell and up between the fins between baffles 18*a* and 18*b* and so on toward the shell fluid outlet. In order to prevent a substantial portion of the fluid from bypassing the fins, anti-bypass flow blockers 22 are attached to the tip of the fins at the cut points of the baffles as shown in FIG. 2 of the drawings. During assembly, the flow blockers are longitudinally attached to the fin tips, the baffles are inserted between the fins at predetermined intervals and also attached to the flow blockers and the fins as shown in FIG. 3**. The assembly is then inserted into the shell and conventional end caps placed at the ends of the shell to form a closed housing except for the fluid inlet and outlet.

Figure 4:
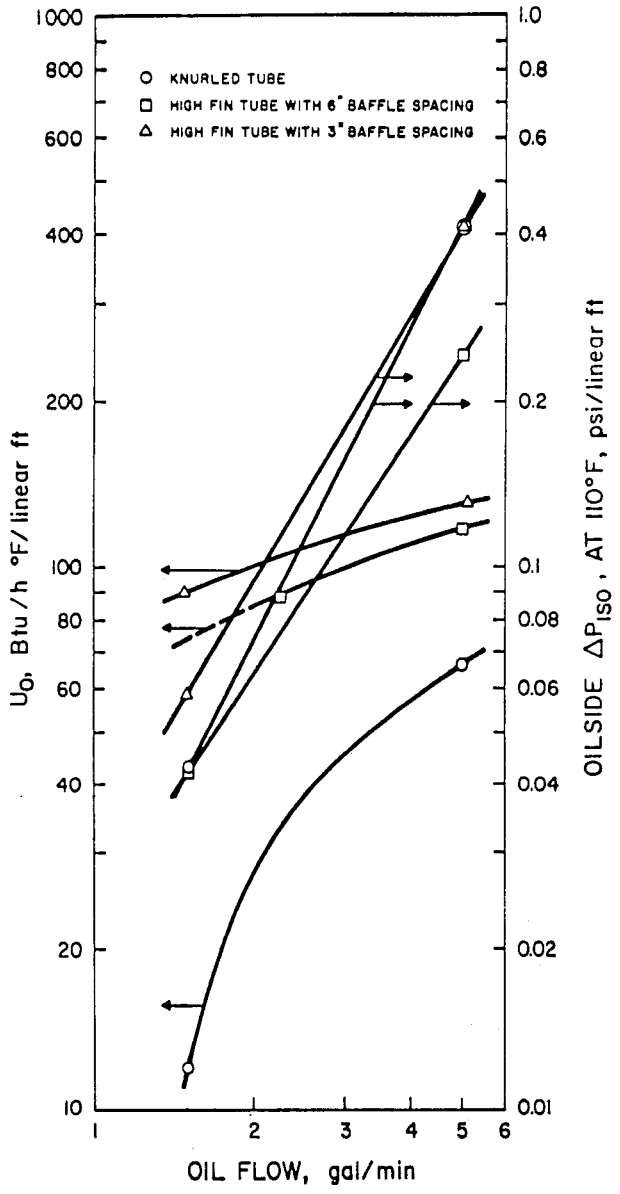
FIGS. 4 and 5 show the results of tests made upon cooling Brayco 888 oil and a 50% mixture of glycol/-water, respectively, with the heat exchanger in accordance with the invention.

Two heat exchangers of the type disclosed above were tested to cool Brayco 888 oil and the heat transfer $U_o$ and pressure drop $\Delta P_{ISO}$ at 110° F. are shown in FIG. 4. The heat exchangers were constructed of a shell having an inner diameter of 2.0 inch and a coaxial high-fin tube having an outer diameter of 0.75 inch and outer diameter over the fins of 1.75 inch. The tubes were fitted with 50% cut baffles at 3 and 6 inch spacing respectively. The shell being 2′ inside diameter, a 0.125 inch annular empty space was left between the tip of the fins and the shell. Two 0.125 inch rods were attached to the fin tips at the cut points of the baffles to minimize bypassing and force the Brayco 888 oil in a cross flow pattern relative to the tube as shown in FIG. 1. The oil flowed in at a temperature of 135° F. The water flow in the tube was 4.5 GPM at 95° F.

The results obtained were compared to those obtained with a heat exchanger having a shell inside diameter of 1.025 inch and a coaxial tube mounted within the shell having an outer diameter of 0.75 inch and external surface augmentation produced by a knurling operation such as disclosed in U.S. application No. 187,413 filed Sept. 15, 1980. It should be noted the tubes in the three heat exchangers were of the same geometry except for the external augmentation. The heat transfer and pressure drop of this reference heat exchanger are also shown in FIG. 4. The gains in heat transfer are substantial at comparable pressure drops. Therefore, for the same application, a shorter length of tube would be required and pressure loss would be even lower. Another major advantage of the design in accordance with the invention is that the heat transfer performance does not deteriorate as badly as the reference heat exchanger at the lower oil flow rates (1.5 to 3 GPM). This relatively flat performance characteristic provides versatility for variable operating conditions and system design.

Figure 5:
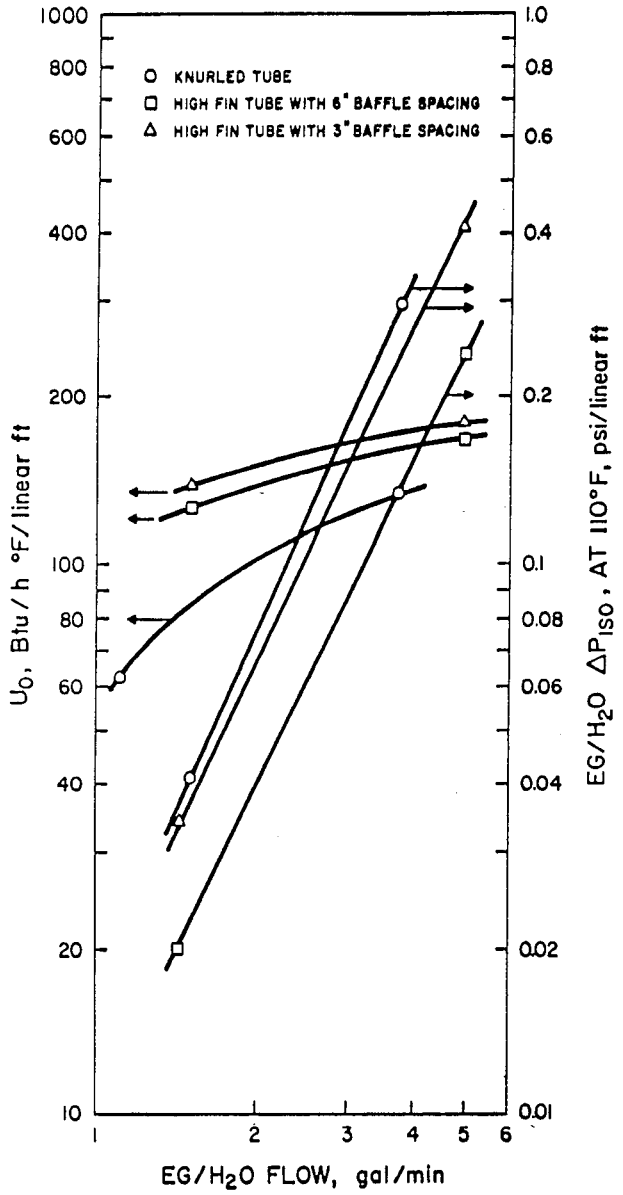

Tests were also carried out with the same tubes using a less viscous 50% mixture of Glycol/Water and the results are shown in FIG. 5. The gains in heat transfer are less substantial but still appreciable.

The above tested heat exchangers had a ratio of heat transfer to total volume of 161 $ft^2/ft^3$ which is substantially higher that the conventional multi-tube heat exchangers. In addition to the above, applicant believes the labor portion of the total cost would be less with the invention than with a multi-tube and shell unit. Applicant bases this on the machining of the many baffle and tubesheet holes with the subsequent threading and attachment of the tubes to the tubesheets. In the new heat exchanger, there is one hole on each end only.

It is to be understood that the invention is not limited to the use of 50% cut baffles and that other segmental cuts are also envisaged. Similarly the baffle spacing as well as the gap between the fin tips and the shell inside diameter will depend on the application.

Figure 6:
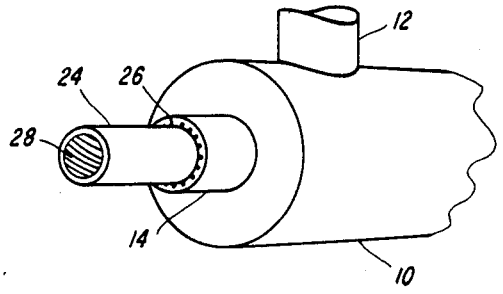
FIG. 6 shows a heat exchanger in accordance with the invention provided with leak detection.

As shown in FIG. 6 of the drawings, a second tube 24 may be inserted inside the high-fin tube 14 and suitable groove 26 provided on the inside surface of tube 14 for leakage detection. Such second tube 24 may be provided with internal fins 28 or other tube augmentation schemes.

What is claimed is:

1. A coaxial finned tube heat exchanger comprising a hollow shell, a tube mounted coaxially within such shell and having radially extending outer fins of substantially large radial dimension in relation to the tube diameter, means for passing a first heat exchanger fluid in said tube, and means for passing a second heat exchanger fluid through said shell, characterized in that a plurality of segmental cut baffles are mounted between adjacent fins at a predetermined spacing within said shell so as to achieve a cross-flow pattern for said second fluid between the fins of said tube, and in that a pair of bypass flow blockers are mounted longitudinally on the tip of the fins to block circumferential flow of said second fluid between said shell and the tips of the fins and so force the fluid flow between the fins.

2. A heat exchanger as defined in claim 1, wherein said bypass flow blockers are a pair of rods or strips attached to the fin tips at the cut points of the baffles.

3. A heat exchanger as defined in claim 1, wherein the tube is internally finned.

4. A heat exchanger as defined in claim 1, wherein the ratio of fin height to tube diameter is in a range between 2 to 1 and 3 to 1.

5. A heat exchanger as defined in claim 1, wherein the tube is smooth on the inside.

6. A heat exchanger as defined in claim 5, further comprising a second tube located inside said finned tube and wherein suitable grooves are provided in the inside of said finned tube or the outside of said second tube for detecting leakage of said finned tube.

7. A heat exchanger as defined in claim 6, wherein said second tube is internally finned.

8. A heat exchanger as defined in claim 6, wherein said second tube is smooth on the inside.

* * * * *